US005222738A

United States Patent [19]

Müller

[11] Patent Number: 5,222,738

[45] Date of Patent: Jun. 29, 1993

[54] GAMBLING DEVICE

[75] Inventor: Rudolf Müller, Nürnberg, Fed. Rep. of Germany

[73] Assignee: Werner & Pfleiderer GmbH, Fed. Rep. of Germany

[21] Appl. No.: 781,232

[22] PCT Filed: Jul. 4, 1990

[86] PCT No.: PCT/EP90/01071

§ 371 Date: Dec. 31, 1991

§ 102(e) Date: Dec. 31, 1991

[87] PCT Pub. No.: WO91/01783

PCT Pub. Date: Feb. 21, 1991

[30] Foreign Application Priority Data

Jul. 26, 1989 [DE] Fed. Rep. of Germany ..... 3924666

[51] Int. Cl.[5] ..... A63F 5/04; A63F 9/00; A63H 15/02

[52] U.S. Cl. ..... 273/142 H; 273/142 R; 446/241; 446/243; 446/489

[58] Field of Search ..... 273/142 H, 142 HA, 142 R, 273/142 A, 142 B, 142 C, 142 D; 446/489, 241, 243, 244

[56] References Cited

U.S. PATENT DOCUMENTS 2,961,796 11/1960 Davis ..... 446/489
3,844,562 10/1974 Foley et al. ..... 273/110
4,042,247 8/1977 Harrington ..... 273/141 A

FOREIGN PATENT DOCUMENTS 1986429 5/1968 Fed. Rep. of Germany ... 273/142 H

*Primary Examiner*—Benjamin H. Layno
*Attorney, Agent, or Firm*—Laff, Whitesel, Conte & Saret

[57] ABSTRACT

A gambling device has a base plate (1') and attached to the latter a spring rod (2) to be set moving in bending oscillations. Several disks (15 to 18) are arranged on the latter. The lowermost disk is formed as a catch disk (18) to which pin-shaped spacers (21) and upwards protruding catching pins (22) are attached.

13 Claims, 1 Drawing Sheet

(13)
13
33
18
22
17
16
21
15
2
1'
14
13
33
26
32
f
18
29
e
25
31
17
28
d
24
h
g
16
30
27
c
20
19
23
f
22
15
a
21
12

15'
22'
37

13
2
33
18
17
16
15
21
21
34
6
7
1
35
4
5
3
36

2
b
9
6'
8
7
1'
10
11

GAMBLING DEVICE

FIELD OF THE INVENTION

The invention relates to a gambling device with an oscillatory spring rod clamped in a base plate and finished with an operating knob at its upper free end, on which spring rod several disks are arranged for free displacement, of which a lower play disk has symbols such as numerals, letters or other symbols and of which an upper play disk has at least one window, a marking or the like, associated with one of the symbols, a spacer being provided spacing the disks from the base plate in their position of rest, at least the play disks being provided with a ring of locking holes and catching devices being provided associated with the latter.

BACKGROUND OF THE INVENTION

A gambling device of the generic type is known from German utility model 19 86 429. The basic idea of this known gambling device is good; it did not prove successful in practice since the oscillation properties of the whole system needed improvement in particular with regard to a descent of the disks sufficiently expanded in time from oscillation to position of rest in unpredictable angular positions one relative to the other.

SUMMARY OF THE INVENTION

It is accordingly the object of the invention to improve a gambling device of the above generic type such that with the oscillation behaviour improved the disks descend one after the other in sufficient time intervals taking in each case unpredictable angular positions one relative to the other.

The object is attained in accordance with the invention in that, on a catch disk freely displaceable on the spring rod and facing the base plate, the spacer associated with the base plate and the catching devices in the form of catching pins facing the lower play disk are arranged, which catching pins are formed to accommodate all the disks arranged above the catch disk. By the measures according to the invention it is achieved that the lower catch disk having a comparatively great mass together with the spacers and the catching pins also ascends on the spring rod at the beginning of the oscillations thus increasing the oscillating time on the whole. On the other hand this mass is the first to sink downwards. The other disks start to descend only afterwards each in a defined manner. They are all accommodated on the catching pins of the catch disk.

When the spacer consists of several pins each formed integrally with one of the catching pins, a particularly simple technical solution is created for the spacer on the one hand and for the catching pins on the other.

Due to the clamping point of the spring rod being adjustable in height relative to and on the base plate the oscillation behaviour of the entire device can be modified, since the distance between the catch disk supported by way of the spacer on the top side of the base plate in its position of rest and the clamping point of the spring is modified.

When a gyroscopic disk is arranged above the upper play disk, there is the possibility to create another additional play disk amplifying the range of gambling.

The measure of a weight being arranged between the gyroscopic disk and the operating knob for free displacement on the spring rod creates a further possibility to influence the oscillation behaviour on the one hand and the speed of the descent of the disk on the other hand.

When the diameters of openings of the play disks receiving the spring rod decrease from the bottom to the top, this will equally help with the descent of the disks in expanded time intervals.

Further advantages, features and details of the invention will become apparent from the ensuing description of two examples of embodiment taken in conjunction with the drawing.

BRIEF DESCRIPTION OF THE DRAWING

FIG. 1 shows a gambling device according to the invention when played with,

FIG. 2 is a section of a gambling device according to the invention in its position of rest with a height-adjustable clamping point of the spring rod, FIG. 3 is an exploded view of a gambling device with a different kind of clamping of the spring rod on the base plate, and FIG. 4 shows a modified embodiment of a catch disk.

DESCRIPTION OF THE PREFERRED EMBODIMENTS

Figures 1, 2, 3, 4:
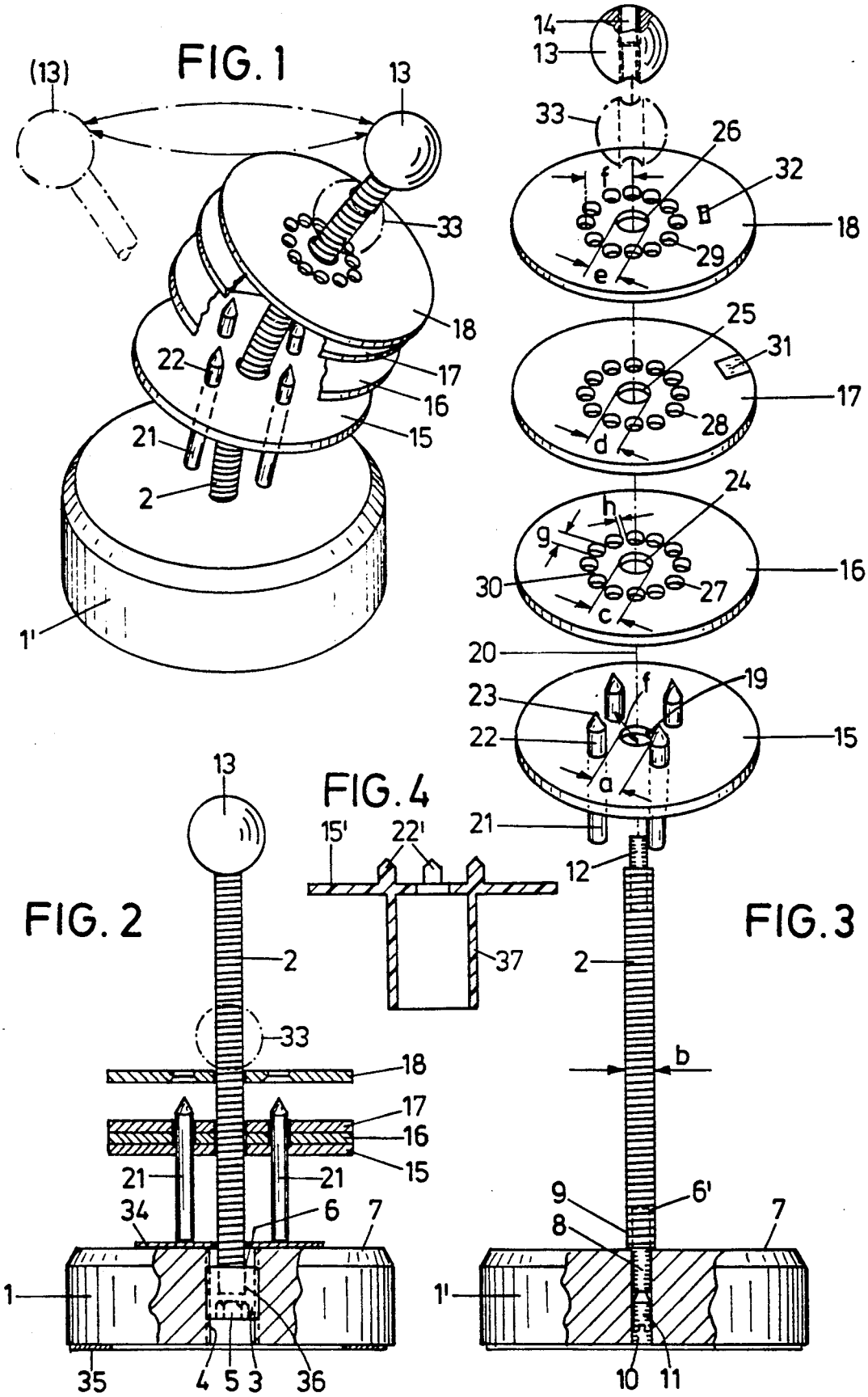

A spring rod 2 in the form of a completely closely wound screw spring is arranged on a comparatively heavy base plate 1 of steel. In accordance with the embodiment according to FIG. 2 the spring rod 2 is attached to a screw 3 of a greater diameter than that of the spring rod 2, which is screwed into a corresponding threaded bore 4 passing through the base plate 1, the screw 3 being self-retaining. At its bottom side the screw 3 is provided with a hexagonal socket 5 so that it can be screwed in different positions into the threaded bore 4. Its length is clearly smaller than the thickness of the base plate 1. Thus the position of the clamping point 6 of the spring rod 2 at the top of the screw 3 can be modified in relation to the top side 7 of the base plate 1.

In the example of embodiment according to FIG. 3 a threaded bolt 8 is screwed into the spring rod 2 and gets arrested in engagement with the turns 9 of the spring rod 2.

It is in turn screwed into a corresponding threaded bore 10 of the base plate 1'. A counter-screw 11 is screwed from below into this threaded bore 10 to secure the threaded bolt 8 with the spring rod 2.

A threaded bolt 12 is in turn screwed into the spring rod 2 at its upper end and is braced against the turns 9. A ball-shaped knob 13 serving as a handle and a safety finish is screwed onto the projecting end of the threaded bolt 12 and, as seen in FIG. 3, has a threaded bore 14 throughout. Consequently, another component such as a flag or the like may be screwed into this threaded bore 14 open to the top.

In each of the examples of embodiment shown four disks are arranged on the spring rod 2. A catch disk 15 is arranged facing the base plate 1 or 1', respectively. A lower play disk 16 and an upper play disk 17 are provided above the catch disk 15. A gyroscopic disk 18 is on top of them.

The catch disk 15 has a central opening 19 through which the spring rod 2 is guided. The diameter a of this opening 19 is slightly greater than the diameter b of the spring rod 2. In symmetry with the common central longitudinal axis 20 a number of pins—in the present case four and as a rule three to five—are provided in the catch disk 15 as a spacer 21, which bear on the top side 7 of the base plate 1 or 1', respectively, in the position of rest and which maintain the catch disk 15 in a position parallel to and at a distance from the top side 7. Catching pins 22 projecting upwards over the catch disk 15 are provided to be integral with the pins of the spacer 21. These catching pins 22, too, extend in parallel to the axis 20. The lower play disk 16, the upper play disk 17 and the gyroscopic disk 18 equally have openings 24, 25, 26, of which the diameter c, d and e, respectively, is also greater than the diameter b of the spring rod 2. Moreover, the diameters c, d, e decrease from the bottom to the top, i.e. the diameter e of the opening 26 of the gyroscopic disk 18 is smaller than the diameter d of the opening 25 of the upper play disk 17. The latter is in turn smaller than the diameter c of the opening 24 of the lower play disk 16. All the four disks 15 to 18 are circular disks and concentric of the axis 20. The difference of the diameters c, d, e is in the range of 0.2 to 0.4 mm with a diameter of the spring rod of for instance 2 to 5 mm. The disks 15 to 18 consist of a transparent plastic material, for instance of a crystal-clear polycarbonate. The two play disks 16, 17 and the gyroscopic disk 18 are of the same thickness and thus of the same weight, whereas the catch disk 15 has a greater thickness and thus a greater weight. Moreover, the total weight of the catch disk 15 with the spacer 21 consisting of steel pins and comprising the catching pins 22 is clearly greater than the weight of the disks 16 to 18.

Locking holes 27, 28, 29 are provided in the play disks 16, 17 and the gyroscopic disk 18, they are arranged in a circle with the axis 20 as a centre and their centre-to-centre distance f from the axis 20 is identical with the centre-to-centre distance f of the catching pins 22 from the axis 20. The locking holes 27 to 29 are arranged at an identical distance from each other, i.e. with the same angular spacing relative to the axis 20, the number of the locking holes 27 and 28 and 29, respectively, on each disk 16, 17, 18 being an integer multiple of the number of the catching pins 22. The latter are also arranged with identical angular spacing, in the present case at a distance of 90° one relative to the other, on the catch disk 15. Given four catching pins 22 the number of locking holes 27, 28, 29 is 8 or 12 or 16 etc. The number essentially depends on the centre-to centre distance f on the one hand and on the diameter g of the hole 27, 28, 29, a marginal condition being that the web 30 remaining between two adjacent locking holes 27 or 28 or 29, respectively, only has a width h which is clearly smaller than the diameter g. $h<0.2$ g should apply. Of course other divisions are possible as well.

A number of symbols not shown in the drawing and equalling the number of locking holes 27, for instance the numerals 1 to 12, is arranged on the lower play disk 16. A window 31 is marked on the upper play disk 17 and has an angular aperture corresponding to 360° divided by the number of locking holes 27 or 28, respectively. The symbols on the lower play disk 16 and the associated window 31 are in the vicinity of the periphery of the two disks 16, 17. In addition a further circle of not shown symbols, for instance the numerals 1 to 12, may be arranged on the upper play disk 17, and that within the circle of the symbols arranged on the lower play disk 16. A mark 32 on the gyroscopic disk 18 may be associated with these symbols.

In addition a weight 33 in the form of a ball may be arranged on the spring rod 2 for free displacement relative to the latter between the uppermost disk, namely the gyroscopic disk 18 and the knob 13.

Playing with the gambling device takes place as follows:

The player taps the knob 13 with his hand about perpendicularly to the spring rod 2, so that it is deflected—as seen in FIG. 1. The spring rod 2 is thus set oscillating bending about its clamping point 6 or 6', the oscillations extending on one plane or rather spatially. As a result all the disks 15 to 18 and—if available—the weight 33 are displaced upwards in the direction towards the knob 13, whereby the distance of the oscillating mass and thus the moment of inertia of the oscillating system is in turn increased. The heavier the mass of the disks 15 to 18 and possibly of the weight 33 on the whole, the longer the spring rod 2 will oscillate with the latter. When the oscillations have experienced absorption to some extent, then the catch disk 15 with its spacer 21 and the catching pins 22 first descends on the spring rod 2, so that the pins of the spacer 21 bear on the top side 7 of the base plate 1 or 1'. The latter may be at least partially covered by a washer 34, which particularly presents itself in an embodiment according to FIG. 2.

Next the lower play disk 16 descends and that by a time lead of the upper play disk 17, which is in particular caused by the opening 24 in the lower play disk 16 having a greater diameter c than the opening 25 of the upper play disk 17. For the same reason the gyroscopic disk 18 descends lagging in time behind the upper play disk 17.

In particular in the final stage of their oscillation or descent the individual disks 16, 17, 18 are subject to a spin effect, i.e. they perform a rotary movement relative to the spring rod 2. On the one hand this ensures that the individual disks 16, 17, 18 always take a different position one relative to the other, which is important with regard to the playing effect, and that the locking holes 27 and 28 and 29, respectively, reliably slip over the tips 23 of the catching pins 22. It is thus excluded that the webs 30 come to a standstill on the tips 23 of the catching pins 22, thus preventing the disks 16 and 17 and 18, respectively, from slipping downwards into a precisely defined position.

A thin ring 35 of felt or the like is applied to the bottom of the base plate 1 or 1', through which the stability of the base plate 1 or 1' and thus of the gambling device is substantially improved.

As seen in FIG. 2, in the embodiment there illustrated the spring rod 2 is screwed into a threaded bore 36 of the spring 3 where it is arrested.

In the embodiment according to FIG. 3, the threaded bolt 8 is screwed into the spring rod 2, i.e. the part of the spring rod 2 filled by the threaded bolt 8 is rigid in itself and cannot make any bending oscillations. From a physical aspect the clamping point 6' of the spring rod 2 is located at the upper end of the threaded bolt 8 in this embodiment. By the threaded bolt 8 being screwed into the spring rod 2 at different lengths the position of the clamping point 6 relative to the top side 7 of the base plate 1' can be modified as a result. The threaded bolt 8 is then arrested in its corresponding position by the counter-screw 11.

The catch disk 15' according to FIG. 4 differs from the catch disk 15 according to the above embodiments in that only a tubular spacer 37 is provided instead of several pins serving as a spacer and in that the catching pins 22', the catch disk 15' and the spacer 37 are integrally injection-molded from plastic material.

I claim:

1. A gambling device comprising a base plate (1, 1');
an oscillatory spring rod (2) having a lower and clamped in said base plate (1, 1') and provided with an operating knob (13) at its upper free end;
a plurality of disks (15 to 18) arranged on said spring rod (2) for free displacement along the spring rod, of which disks a lower play disk (16) has symbols and of which an upper play disk (17) has at least one of a window (31) and a marking, associated with one of the symbols;
a spacer (21, 37) located between the disks and the base plate, and when the disks (15 to 18) are in a rest position, the spacer (21, 37) rests on the base plate spacing the disks (15 to 18) from the base plate (1, 1');
a ring of locking holes (27, 28) being provided at least in the play disks (16, 17); and
catching devices associated with the locking holes; which catching devices are in the form of catching pins (22, 22') spaced to receive the locking holes of the play disks (16, 17);
wherein the spacer (21, 37) and the catching pins (22, 22') are attached to a catch disk (15, 15'), which is freely displaceable on the spring rod (2), said catch disk (15) is positioned below the other disks (16 to 18) such that in the rest position all the disks (16, 17, 18) are arranged above the catch disk (15).

2. A gambling device according to claim 1 wherein the spacer (21) consists of several pins each formed integrally with one of the catching pins (22).

3. A gambling device according to claim 2 wherein the pins forming the spacer (21) together with the catching pins (22) consist of metal, preferably steel.

4. A gambling device according to claim 1, wherein the clamping point (6) of the spring rod (2) is adjustable in height relative to and on the base plate (1).

5. A gambling device according to claim 4 wherein the spring rod (2) is attached to a screw (3) adjustable in a threaded bore (4) of the base plate (1).

6. A gambling device according to claim 5 wherein the screw (3) is formed to be self-retaining towards the thread of the threaded bore (4).

7. A gambling device according to claim 4 wherein the spring rod (2) is connected with the base plate (1') by a threaded bolt (8) screwed into it.

8. A gambling device according to claim 1, wherein a gyroscopic disk (18) is arranged above the upper play disk (17).

9. A gambling device according to claim 8, wherein a weight (33) is arranged between the gyroscopic disk (18) and the operating knob (13) for free displacement on the spring rod (2).

10. A gambling device according to claim 1 wherein the diameters (c, d, e) of openings (24, 25, 26) of the play disks (16, 17, 18) receiving the spring rod (2) decrease from the bottom to the top.

11. A gambling device according to claim 1, wherein a ring (35) of felt is applied to the bottom and in the vicinity of the periphery of the base plate (1, 1').

12. A gambling device according to claim 1 wherein the catch disk (15') is integrally formed with the spacer (37) and the catching pins (22').

13. A gambling device according to claim 12 wherein the spacer (37) is tubular.

* * * * *

UNITED STATES PATENT AND TRADEMARK OFFICE

CERTIFICATE OF CORRECTION

PATENT NO. : 5,222,738

DATED : June 29, 1993

INVENTOR(S) : Rudolf Muller

It is certified that error appears in the above-identified patent and that said Letters Patent is hereby corrected as shown below:

On the title page, please delete the following:
--[73] Assignee: Werner & Pfleiderer GmbH, Fed. Rep. of Germany--

Signed and Sealed this

Twelfth Day of October, 1993

*Attest:*

Bruce Lehman

BRUCE LEHMAN

*Attesting Officer*

*Commissioner of Patents and Trademarks*